United States Patent [19]

Koo

[11] 4,419,716

[45] Dec. 6, 1983

[54] VAPOR PROOF HOUSING ASSEMBLY AND SYSTEM

[76] Inventor: Stephen Koo, 83-58 Charlecote Ridge, Jamaica, N.Y. 11432

[21] Appl. No.: 455,421

[22] Filed: Jan. 3, 1983

[51] Int. Cl.[3] ..... F21V 33/00

[52] U.S. Cl. ..... 362/96; 362/158; 362/218; 362/294; 362/253; 362/373; 362/457

[58] Field of Search ..... 362/96, 158, 218, 253, 362/294, 373, 457

[56] References Cited

U.S. PATENT DOCUMENTS 4,219,871 8/1980 Larrimore ..... 362/373 X

*Primary Examiner*—Stephen J. Lechert, Jr.

[57] ABSTRACT

A sealed vapor proof housing assembly in combination with a system for isolating an electrical device from the ambient atmosphere comprising a casing having a removable door to provide access to the interior of the casing, a first multiple number of heat exchange fins projecting from the casing into the atmosphere, a second multiple number of heat exchange fins projecting from the casing within the interior thereof for transferring heat from the interior to the ambient atmosphere, a sleeve liner disposed within the casing contiguous to the interior fins for forming a compartment with the liner having open ends spaced from the door and rear end of the casing. A fan is mounted on the liner for circulating air in a closed circulating pattern in intimate contact with the interior fins. Air is pumped into the casing through a one way valve and a pressure switch is electrically coupled to the fan and a power source for disabling the fan in response to a leak in the casing.

11 Claims, 4 Drawing Figures

VAPOR PROOF HOUSING ASSEMBLY AND SYSTEM

This invention relates to a sealed vapor proof housing assembly for isolating an electrical device from the ambient atmosphere and to a combination sealed vapor proof housing assembly and system for isolating an electrical device within an enclosed atmosphere, cooling the enclosed atmosphere and for automatically detecting the presence of a leak between the enclosed atmosphere and the ambient atmosphere.

Electrical devices which give off substantial energy in the form of heat are potentially hazardous to use in an atmosphere containing gasoline fumes or other explosive vapors. An airplane hanger or mine field would represent typical examples in which the ambient atmosphere can be saturated with gasoline or other explosive vapors. In such an environment even conventional electrical devices such as a lamp, power supply or even an electrically operated motor if unprotected can represent a safety hazard in which the normal operation of the electrical device can lead to an explosion.

Safety standards require electrical devices such as electrical instrumentation and lighting systems to be protected from use in any ambient atmosphere in which explosive vapors are present. A sealed housing would provide isolation for the electrical device and accordingly would be an ideal enclosure. However, there is no commercially available sealed vapor proof housing which can isolate an electrical device within a protective atmosphere without suffering from an increase in temperature due to the heat generated from the electrical device. An increase in housing temperature can cause the electrical device to malfunction or fail. In addition, the housing enclosure can itself become a safety hazard from an uncontrolled build up of heat within the enclosure. An electrical device for purposes of the present invention is intended to encompass electrical and electronic instrumentation and lighting systems or assemblies.

The housing assembly of the present invention comprises a sealed enclosure for isolating an electrical device within a protective atmosphere and a cooling system for transferring heat from the protective atmosphere to the ambient atmosphere in order to maintain the temperature of the sealed housing within safe limits. The housing assembly and system of the present invention further includes means for detecting the existence of a leak between the enclosed atmosphere and the ambient atmosphere and means for disabling the electrical device in response to the presence of such a leak. The latter feature provides assurance that the housing assembly is truly sealed and leak free.

It is accordingly the principle object of the present invention to provide a sealed vapor proof housing assembly for isolating an electrical device from the ambient atmosphere.

It is another object of the present invention to provide a sealed vapor proof housing assembly and system for isolating an electrical device from the ambient atmosphere, transferring heat generated by the electrical device to the ambient atmosphere without substantially raising the temperature of the housing and for detecting the existence of a leak between the sealed housing and the ambient atmosphere.

Other features and advantages of the present invention will become apparent from the following detailed description of the invention when read in conjunction with the accompanying drawings in which.

Figure 1:
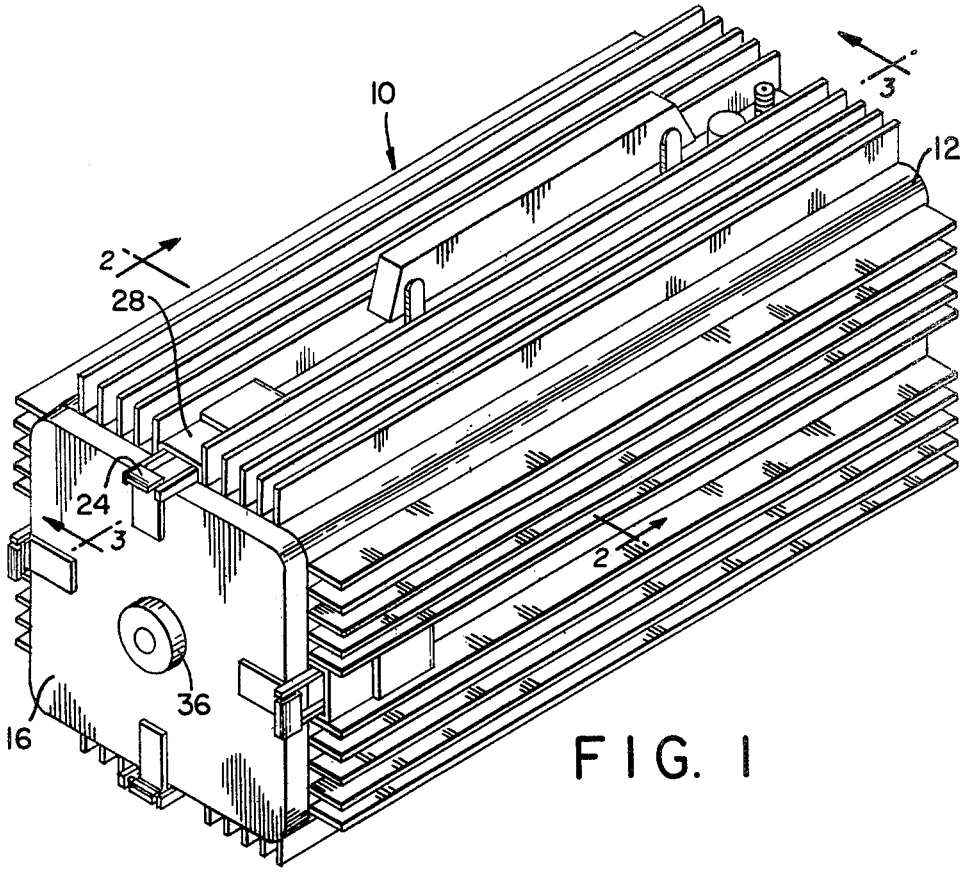
FIG. 1 is a perspective view of the sealed vapor proof housing assembly of the present invention.

Referring now to FIGS. 1 to 4 inclusive in which is shown the vapor proof housing assembly 10 of the present invention. The vapor proof housing assembly 10 comprises a hollow casing 12 forming a sealed enclosure 13 for isolating an electrical device 14 from the ambient atmosphere surrounding the housing 10. The casing 12 has a removable front door panel 16 for providing access to the electrical device 14. The casing 12 may be composed of any relatively high thermal conducting material preferably aluminum and may be of any desired geometry and size to accommodate the electrical device 14.

For ease of manufacture the casing 12 is preferably of rectangular geometry having four side walls 17, 18, 19 and 20 and a rear wall 21. The rear wall 21 is disposed in a plane transverse to the side walls. The front door panel 16 is held in engagement against a lip 22 which extends from each of the side walls 17, 18, 19 and 20. Any conventional pull or latch type locking mechanism 8 may be used to removably hold the front door panel 16 securely against each of the side walls of the casing 12. The latch 8 should include a handle 23 for manually engaging or disengaging a hook 24 extending from the front door 16. The latch 8 should be of the type which will press the front door 16 into tight engagement against the lip 22. An elastomeric gasket 24 should also be used to form an air tight seal between the front door panel 16 and the lip 22 extending from each side wall 17, 18, 19 and 20 respectively. The gasket 24 may be removably inserted in a recess 25 in the front door 16 or adhesively secured to the front door panel 16 in a position to abut the lip 22.

The front door panel 16 may have an opening 32 representing a portal for transmitting light from a light source 33 mounted in a conventional light source reflector assembly 34 affixed to the front door panel 16 by any mounting means such as screws 26 or through a mounting bracket (not shown) affixed to the front door panel 16. The light source 33 may represent any conventional source of light such as an ultraviolet mercury lamp of e.g. 50–150 watt. The opening 32 is closed with an air tight glass window 35 which may also represent an optical filter for the light source 33 to control the output wavelength of the light source 33. The glass window 35 may be cemented to the inside surface 31 of the door panel 16 in a position surrounding the opening 32 or removably inserted in a mounted bracket 39 which is secured by screws 36 to the front door 16. In the latter case an "O" ring 37 is mounted between the filter 35 and the front door panel 16 to seal the opening 32. A cylindrical adaptor 36 extends from the front door panel 16 to receive a light transmitting conduit such as fiber optic light guide or pipe (not shown).

The casing 12 includes a first multiple number of exterior heat exchange fins 38 which project outwardly from the side walls 17, 18, 19 and 20 into the ambient atmosphere and a second multiple number of interior heat exchange fins 40 which project from the side walls 17, 18, 19 and 20 inwardly into the enclosure 13. The fins 38 extend lengthwise along each of the side walls 17, 18, 19 and 20 in a parallel arrangement from the end adjacent the front door 16 to the rear wall 21. Likewise the fins 40 extend lengthwise along each of the side walls 17, 18, 19 and 20 from the lip 22 to the rear wall 21. The fins 40 are preferably arranged in a complimentary fashion to the exterior fins 38. The number of exterior and interior fins 38 and 40, the distance separating the exterior fins 38 from one another and the spacing between interior fins 40 are design factors relating to the efficiency in heat transfer between the interior fins 40 and the exterior fins 38. This is also true of the width of the fins 38 and 40 which need not be of the same size. In fact, it is preferred that the interior fins 40 be smaller in width than the exterior fins 38. Both the exterior and interior fins 38 and 40 should be of a high termal conductivity material such as aluminum. The casing 12 may be cast extruded with the interior fins 20 in a single operation. The exterior fins 38 are preferably aluminum welded to the side walls 17, 18, 19 and 20 of the casing 12.

A sleeve liner 42 is removably inserted into the enclosure 13 to form a compartment 44, having one open end adjacent the front door panel 16 and a second open end adjacent the rear wall 21, for controllably recirculating forced air or another medium within the enclosure 13 as will be explained in detail hereinafter. The sleeve liner 42 may be of any geometry which slidably engages the interior fins 40. A simple rectangular geometry is preferred. The sleeve liner 42 must have a length "L" which is shorter in dimension than the corresponding length of the side walls 17, 18 19 and 20 so as to form clearance spaces 46 and 47 between the sleeve liner 42, the front door 16 and the rear wall 21. The clearance spaces are formed upon insertion of the sleeve liner 42 into the enclosure 13. The clearance spaces 46 and 47 need not be of identical length. The sleeve liner 42 should preferably fit snugly against the interior fins 40. A stop (not shown) may be attached to one of the interior fins 40 to properly recess and hold the sleeve liner 42 in place within the enclosure 13. The sleeve liner 42 may be composed of a highly conductive material such as aluminum or of a plastic material such as teflon with the latter being selected when electrical isolation is desired without ground interference.

An electrical fan 50 is mounted in the sleeve liner 42 with its radial blades 51 extending in a plane transverse to the side walls of the casing 12. The electrical fan 50 is driven by a motor M having brace members 52 connected to the sleeve liner 42. All of the components representing the electrical device 14 exclusive of the lamp 33 and lamp reflector 34 are preferably mounted in the sleeve liner 42 between the fan 50 and the rear wall 21. A power cord 55 extends from the electrical device 14 through an air tight coupling plug 56 in the rear wall 21 of the casing 12. The air tight coupling plug 56 consists of a member 57 which threads into the rear wall 21 and an outer nut 58 which threadably engages the member 57. The member 57 has a bore 59 through which the power cord passes. An "O" ring 60 surrounds the power cord 55 and lies between the member 57 and the nut 58. By tightening the outer nut 59 against the rear wall 21 the coupling plug 56 becomes air tight.

Air or another coolant is driven by the fan 50 in a predetermined pattern as indicated by the arrows. The air flows from inside the compartment 44 passing through the clearance space 46 between the sleeve liner 42 and the front door panel 16 whereupon the air reverses direction and travels axially from the front door panel 16 to the rear wall 21 in intimate contact with the internal heat exchange fins 40. Upon reaching the rear wall 21 the air reverses direction and passing back through the compartment 44 to form a closed recirculating flow path. The fan should operate at a relatively high speed.

The air within the enclosure 13 is preferably pressurized. A one way air valve 62 is threadably inserted through one of the side walls 17 into the enclosure 13. The air valve 62 is of conventional design e.g. a conventional tire valve which permits air to be pumped into the enclosure 13 from a supply (not shown) using any conventional pumping mechanism. A conventional pressure gage 64 is threaded through the casing 12 for providing a positive indication of the pressure within the enclosure 13. The pressurized atmosphere in the enclosure 13 increases the efficiency of heat transfer between the enclosure 13 and the ambient atmosphere. The atmosphere in the enclosure 13 can contain any desired gas composition or coolant for further increasing the heat transfer efficiency between the atmosphere in the enclosure 13 and the ambient atmosphere.

Figure 4:
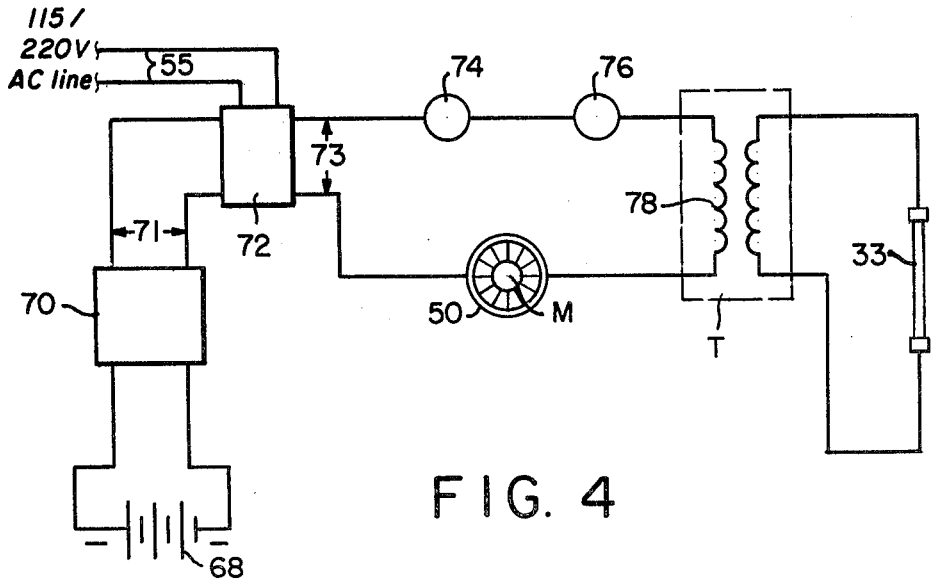
FIG. 4 is a simplified electrical schematic diagram of an ultraviolet light source system representing the electrical device enclosed within the vapor proof housing assembly of the present invention.
Figure 2:
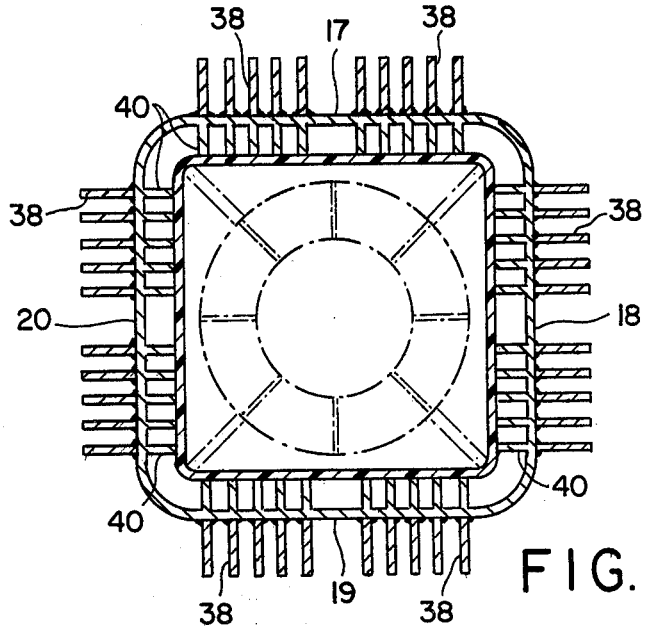
FIG. 2 is a cross-sectional view of the vapor proof housing assembly taken along the lines 2—2 of FIG. 1.
Figure 3:
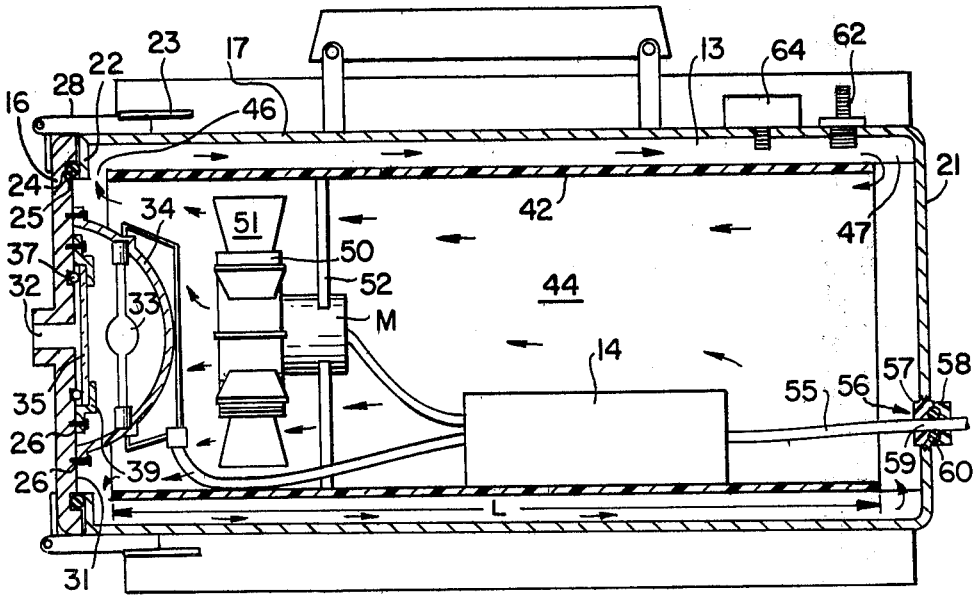
FIG. 3 is a cross-sectional view of the vapor proof housing assembly of the present invention taken along the lines 3—3 of FIG. 1.

Power is supplied to the motor M for driving the fan 50 from the electrical device 14 which, as is shown in FIG. 4, provides power from a battery 68 or from an external 115 volt or 220 volt AC line supply through the power cord 55. The battery 68 is coupled to a conventional inverter 70 for converting the DC potential output from the battery 68 to an alternating output 71 at line frequency. The alternating output 71 from the inverter 70 is applied through a conventional switch or switching circuit 72 which may be either manual or electronic for switching from either the battery 68 or the AC source of line potential. The output 73 from the switch 72 is applied to a series circuit including a conventional pressure actuated switch 74, a conventional temperature actuated switch 76, the primary winding 78 of a power transformer T and the motor M for the fan 50. The pressure actuated switch 74 is a conventional device which in its simplest form represents two contacts spaced apart and enclosed within a flexible diaphragm responsive to pressure within the enclosure. When the pressure in the enclosure 13 increases to a predetermined level the diaphragm collapses to keep the contacts closed. The temperature actuated switch 76 is also a conventional device including normally closed contacts which are caused to open in response to an increase in temperature in the enclosure above a predetermined set level.

The output from the power transformer T is applied to the lamp 33 in the reflector assembly 34 for generating light through the filter 35 mounted on the front door panel 16. Any leak in the enclosure 13 will decrease the pressure and cause the contacts in the pressure actuated switch 74 to open thereby opening up the series circuit and removing power from the lamp 33. Moreover, any extraordinary rise in temperature above a predetermined level will cause the temperature actuated switch 76 to open. In either instance the circuit is disabled and power disconnected.

What I claim is:

1. A sealed vapor proof housing assembly for isolating an electrical device from the ambient atmosphere external of said housing comprising: a hollow casing having a removble door for providing access to the interior of the casing; means for securing said door against said casing to provide a sealed enclosure within the interior thereof; a first multiple number of heat exchange fins projecting from said casing into the ambient atmosphere; a second multiple number of heat exchange fins projecting from said casing within said enclosure; a sleeve liner disposed within said enclosure contiguous to said second multiple number of heat exchange fins for forming a compartment within said enclosure; said sleeve liner having two open ends with each open end being recessed a predetermined distance from said casing to provide a clearance space at each open end between said sleeve liner and said casing, said electrical device being mounted upon said sleeve liner in said compartment and a power driven fan for circulating a cooling fluid in a closed circulating pattern through said compartment and said enclosure in intimate contact with said second multiple number of heat exchange fins.

2. A sealed vapor proof housing assembly as defined in claim 1 wherein said cooling fluid is air.

3. A sealed vapor proof housing assembly as defined in claim 2 wherein said casing is substantially rectangular in geometry having four side walls and a rear wall transverse to the side walls.

4. A sealed vapor proof housing assembly as defined in claim 3 wherein said first multiple number of heat exchange fins project from each of said side walls in a parallel arrangement from one end of said casing adjacent said door to said rear wall.

5. A sealed vapor proof housing assembly as defined in claim 4 wherein said second multiple number of heat exchange fins project inwardly from each of said side walls in a parallel complimentary arrangement with said first multiple number of fins.

6. A sealed vapor proof housing assembly as defined in claim 5 wherein said door has an opening and a window in sealed engagement with said door.

7. A sealed vapor proof housing assembly as defined in claim 5 wherein said electrical device comprises a power supply and a lamp assembly.

8. In combination a sealed vapor proof housing assembly and system for isolating an electrical device from the ambient atmosphere external of said housing comprising a casing having a removable door for providing access to the interior of the casing; means for securing said door against said casing to provide a sealed enclosure within the interior thereof; a first multiple number of heat exchange fins projecting from said casing into the ambient atmosphere; a second multiple number of heat exchange fins projecting from said casing within said enclosure; a sleeve liner for forming a compartment within said enclosure, said sleeve liner having two open ends; a fan mounted on said sleeve liner; said electrical device including means for applying power to said fan and means for pressurizing said enclosure.

9. In combination as defined in claim 8 wherein said means for pressurizing said enclosure includes an air valve mounted in said casing.

10. In the combination of claim 9 further comprising means responsive to the pressure in said enclosure for disabling said electrical device when the pressure is below a predetermined level.

11. In the combination as defined in claim 10 wherein said electrical device comprises a source of ultraviolet light and wherein said door includes a portal for transmitting light from said ultraviolet light through said door.

* * * * *